United States Patent [19]

Ototani

[11] Patent Number: 5,055,018

[45] Date of Patent: Oct. 8, 1991

[54] CLEAN STEEL

[75] Inventor: Tohei Ototani, Tokyo, Japan

[73] Assignee: Metal Research Corporation, Tokyo, Japan

[21] Appl. No.: 498,069

[22] Filed: Mar. 23, 1990

Related U.S. Application Data

[63] Continuation-in-part of Ser. No. 363,570, Jun. 7, 1989, Pat. No. 4,944,798.

[51] Int. Cl.[5] ..... C21C 7/02

[52] U.S. Cl. ..... 420/8; 420/85

[58] Field of Search ..... 420/8, 85

[56] References Cited

U.S. PATENT DOCUMENTS

| | | | |
|---|---|---|---|
| 4,293,336 | 10/1981 | Matsumura | 420/8 |
| 4,529,441 | 7/1985 | Smith | 420/8 |
| 4,802,918 | 2/1989 | Ooki | 420/8 |
| 4,944,798 | 7/1990 | Ototani | 420/85 |

*Primary Examiner*—Peter D. Rosenberg

*Attorney, Agent, or Firm*—Sughrue, Mion, Zinn Macpeak & Seas

[57] ABSTRACT

A clean steel consisting essentially of by weight 0.0005%-0.5% of aluminum, 0.0001%-0.5% of silicon, 0.00001%-0.0005% of magnesium, 0.00001%-0.0025% of calcium, 0.00001%-0.003% of oxygen 0.00001%-0.003% of sulfur and 0.0001%-0.015% of nitrogen, less than 2% carbon and the remainder iron, wherein the clean steel is further selected from the group consisting of carbon steel consisting of less than 2% of carbon, and common elements of silicon, manganese, phosphorus or sulfur; and alloy steel consisting of general elements and special elements selected from the group consisting of 0.001%-50% of at least nickel, chromium, cobalt or tungsten.

7 Claims, 4 Drawing Sheets

Phase diagram of CaO-MgO system

Phase diagram of CaO-MgO-$Cr_2O_3$ system

Phase diagram of $ZrO_2$-CaO-MgO system

Phase diagram of CaO-MgO-$Al_2O_3$ system

Hydration properties in saturated vapor of CaO, CaO-30%MgO, 20%CrO-CaO-30%MgO (50°C)

Calcium behavior

CLEAN STEEL

This application is a continuation-in-part application of U.S. patent application Ser. No. 363,570 filed Jun. 7, 1989, now U.S. Pat. No. 4,944,798.

BACKGROUND OF THE INVENTION (a) Field of the Invention

The present invention relates to a method of manufacturing a ferroalloy of super high purity, and relates to a method of manufacturing steel containing extremely small amounts of oxygen, sulfur and nitrogen, and small amounts of magnesium and calcium.

(b) Related Art Statement

The inventor has previously proposed a method of manufacturing molten steel having less contents of oxygen and sulfur as Japanese Patent Laid-open No. 52(1977)-58,010 and Japanese Patent Application Publication No. 62(1987)-37,687.

The inventor has further proposed iron-, nickel-, and cobalt-base alloy having extremely small contents of sulfur, oxygen and nitrogen and a method of manufacturing the same as Japanese Patent Laid-open No. 62(1987)-83,435.

According to the above prior methods, the residual sulfur is less than 0.002%, the residual oxygen is less than 0.002% and the residual nitrogen is less than 0.03% in molten steel.

That is, the invention of Japanese Patent Laid-open No. 62(1987)-83,435 relates to a method of manufacturing an iron-base alloy having extremely small contents of oxygen, sulfur and nitrogen comprising a step of substantially melting an iron alloy in a crucible consisting of basic refractories containing 15–75 wt % of MgO and 15–85 wt % of CaO, or a crucible, a crucible melting furnace, a converter or a vessel such as a ladle lined with said refractories, deoxidizing, desulfurizing and denitrifying the molten alloy in a non-oxidizing atmosphere such as argon gas, nitrogen gas or helium gas or in vacuo, by adding first and second additives, the first additive being aluminum or aluminum alloy, and the second additive being selected from the group consisting of boron alkali metal and alkali earth metal, and casting the thus deoxidized, desulfurized and denitrified molten alloy into an ingot.

According to this method, in order to remain

| | |
|---|---|
| residual Al | 0.005–7% |
| residual Mg | 0.005–0.0001% |
| residual Ca | 0.005–0.0001% |
| total residual amount of at least one element selected from the group consisting of boron, alkali metal and alkali earth metal | 0.001–10 wt % |

these metals are preferably added.

SUMMARY OF THE INVENTION

An object of the invention is to improve spalling resistance and hydrating properties as compared with conventional natural dolomite, synthetic calcia.-magnesia refractories.

Another object of the invention is to provide a clean steel consisting essentially of by weight 0.0001%–0.5% of aluminum, 0.0001%–0.5% of silicon, 0.00001%–0.0005% of magnesium, 0.00001–0.0025% of calcium, 0.00001%–0.003% of oxygen, 0.0001%–0.003% of sulfur, and 0.0001%–0.015% of nitrogen, less than 2% of carbon, 0.0001%–0.5% of at least one element selected from the group consisting of titanium, niobium, tantalum, boron and the remainder iron.

Another object of the invention is to provide a clean steel consisting essentially of by weight 0.0005%–0.5% of aluminum, 0.0001–0.5% of silicon, 0.00001%–0.0005% of magnesium, 0.00001%–0.0025% of calcium, 0.00001%–0.003% of oxygen, 0.00001%–0.003% of sulfur, and 0.0001%–0.015% of nitrogen, less than 2% of carbon, 0.0001%–0.5% of at least one element selected from the group consisting of titanium, niobium, tantalum, and boron, minor amount of phosphorous and manganese and alloy steel consisting of 0.001 ~ 50% of at least one element selected from the group consisting of nickel, chromium, tungsten, molybdenum, vanadium and the remainder iron.

Another object of the invention is to provide a clean steel consisting essentially of by weight 0.0005%–0.5% of aluminum, 0.0001%–0.5% of silicon, 0.00001%–0.0005% of magnesium, 0.00001%–0.0025% of calcium, 0.00001%–0.003% of oxygen, 0.00001%–0.003% of sulfur and 0.0001%–0.015% of nitrogen, less than 2% carbon and the remainder iron, wherein the clean steel further include 0.0001%–0.5% of at least one element selected from the group consisting of titanium, niobium, tantalum, boron, wherein said clean steel is further consisting of at least one element selected from the group consisting of nickel, chromium, cobalt, tungsten, vanadium, molybdenum as a special alloy steel.

DESCRIPTION OF THE PREFERRED EMBODIMENTS

The invention will be explained by referring to drawings.

Figure 1:
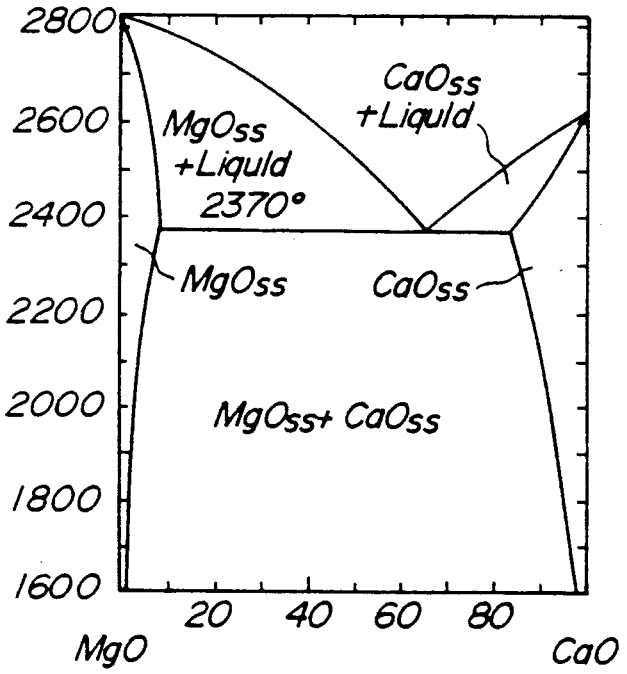
FIG. 1 is a phase diagram of CaO-MgO refractories used in the present invention.
Figure 2:
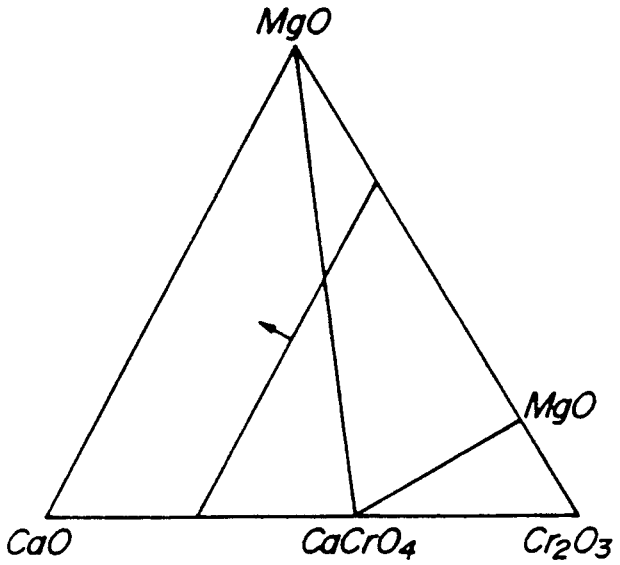
FIG. 2 is a phase diagram of CaO-MgO-$CR_2O_3$ refractories used in the present invention.
Figure 3:
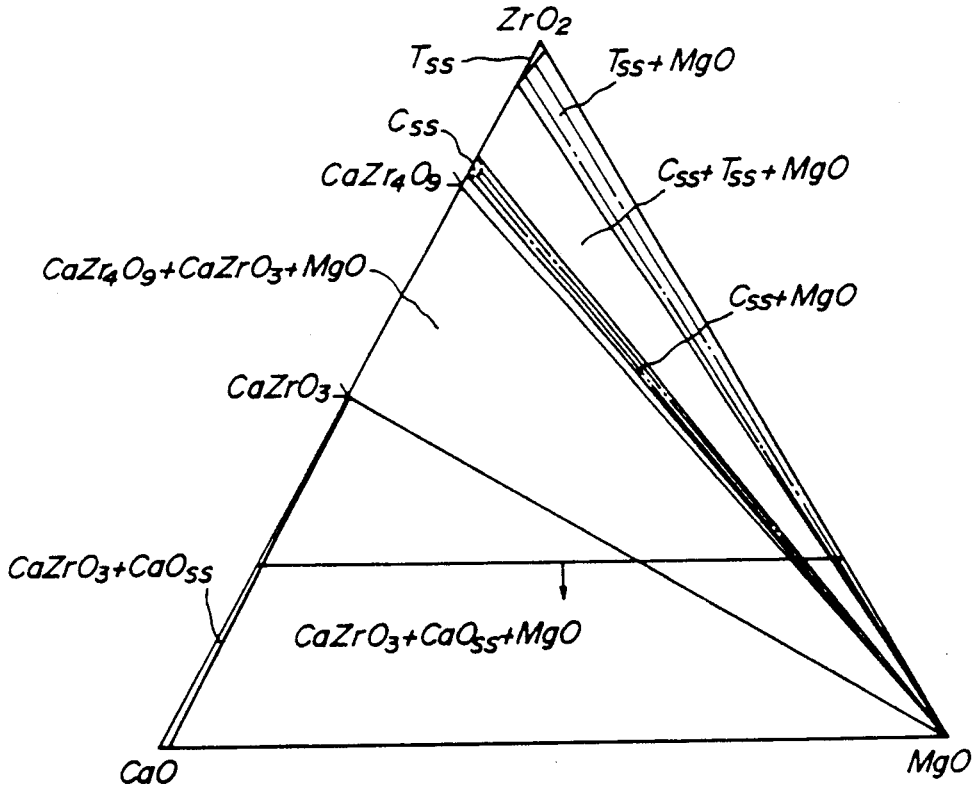
FIG. 3 is a $ZrO_2$-CaO-MgO composition used in the present invention.

FIG. 1 is a phase diagram of CaO-MgO system binary refractories by mixing CaO with MgO. FIG. 2 shows a phase diagram of CaO-MgO-$CR_2O_3$ tertiary system refractories. From FIG. 2 of this phase diagram is obtained a mixed structure of CaO-MgO-$CaCrO_4$ system by adding $Cr_2O_3$. FIG. 3 shows a tertiary phase diagram of refractories of CaO-MgO-$ZrO_2$, and as apparent from FIG. 3, the refractories is a mixed structure of $CaZrO_3$+CaO solid solution+MgO.

Figure 4:
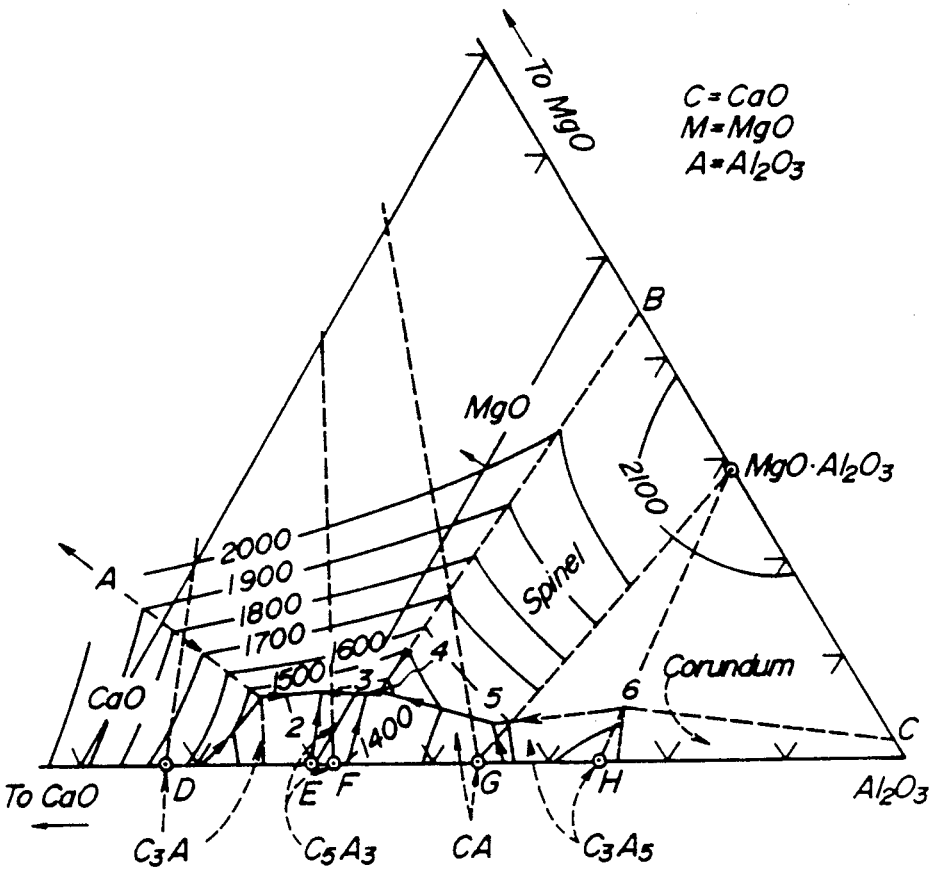
FIG. 4 is a phase diagram of CaO-MgO-$Al_2O_3$ refractories used in the present invention.

FIG. 4 shows a phase diagram of tertiary refractories of CaO-MgO-$Al_2O_3$, and as apparent from FIG. 4, the refractories is a mixed structure of CaO-MgO-5CaO3$Al_2O_3$. These tertiary refractories apparently contain carbide and silicate in part with respect to quarterly refractories of the present invention which further includes C and $SiO_2$ in each of these tertiary refractories.

The phase diagrams of the refractories according to the present invention is rather complicated depending upon the structure and phase diagram, but there are effects of improving spalling resistance by contents and components of tertiary oxide other than CaO and MgO as compared with CaO, MgO and refractories, and more specially, the effect is a remarkably improved, except quarterly refractories containing silicate.

Figure 5:
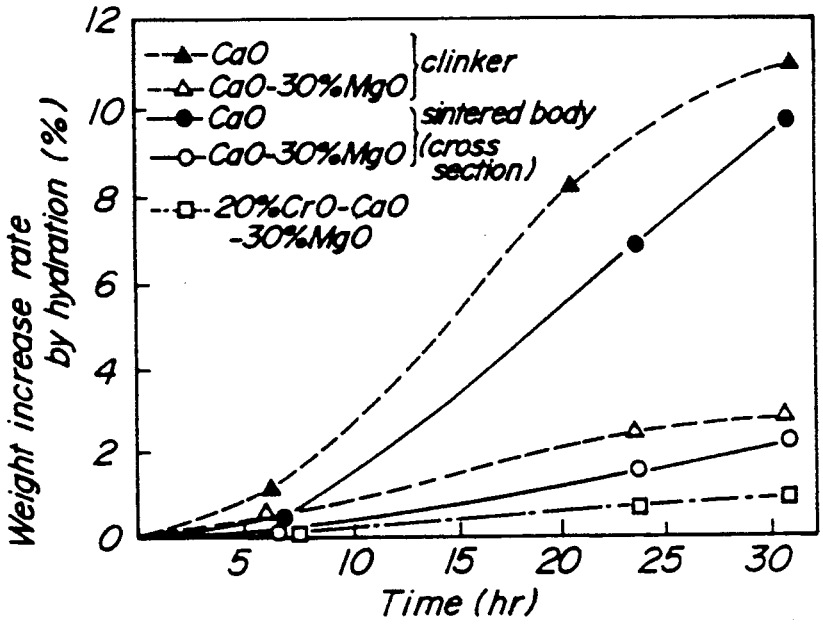
FIG. 5 is a phase diagram showing hydration characteristics of CaO, CaO-30%MgO, 20%CrO-CaO-30%MgO in saturated vapor at 50° C.

FIG. 5 shows the comparative data of hydration properties by comparing the prior data of the fired refractories with respect to the starting material of MgO-70%CaO and with the refractories of 25%MgO-56%CaO containing 18% $Cr_2O_3$. It becomes clear from this comparative data that hydration resistance is improved by mixing 18% of $Cr_2O_3$. Hydration properties of refractories made by mixing tertiary oxide of less than 30% of the present invention with calcia-magnesia (CaO-MgO) is complicately influenced by carbonation and preliminary treatment of the exposed surface, system, porosity and the like, but it is apparent from each phase diagram of tertiary refractories that a mixed structure is obtained by adding a tertiary oxide, thereby hydration properties are greatly improved.

The reducing reaction carried out in the container such as a crucible, a converter or a ladle lined with said refractories of CaO of 7-90 wt % and MgO of 90-7 wt % which total content is 70-99.9% is as follows.

In each of the above embodiments, a part of aluminum (Al) added as an additive to the molten alloy in the container is directly bonded with oxygen in the molten alloy in vacuo or a non-oxidizing atmosphere so as to generate $Al_2O_3$ for deoxidation, but the other part of aluminum (Al) is reacted with MgO and CaO in the refractory surface in vacuo or a non-oxidizing atmosphere in accordance with the following equations to generate Mg, Ca and $Al_2O_3$.

$$3CaO + 2Al \rightarrow 3Ca + Al_2O_3 \quad (1)$$

$$3MgO + b\ 2Al \rightarrow 3Mg + Al_2O_3 \quad (2)$$

The reason why the melting furnace or the container is composed of or lined with refractories having a composition consisting of 90-7% by weight of MgO and 7-90% by weight of CaO in the present invention will be explained as follows.

$$3MgO + CaO + 2Al \rightarrow 3Mg + CaO.Al_2O_3 \quad (3)$$

Calcium aluminate mainly consisting of this $CaO.Al_2O_3$ has high desulfurizing power, and as a result, the desulfurization of the molten alloy proceeds.

The following reaction also occurs by the presence of titanium (Ti), niobium (Nb), tantalum (Ta) and boron (B) in vacuo or a non-oxidizing atmosphere.

$$CaO + \underline{Ti} \rightarrow Ca + TiO \quad (4)$$

$$MgO + \underline{Ti} \rightarrow Mg + TiO \quad (5)$$

$$3CaO + 2Nb \rightarrow 3Ca + Nb_2O_3 \quad (6)$$

$$3MgO + 2Nb \rightarrow 3Mg + Nb_2O_3 \quad (7)$$

$$3CaO + 2Ta \rightarrow 3Ca + Ta_2O_3 \quad (8)$$

$$3MgO + 2Ta \rightarrow 3Mg + Ta_2O_3 \quad (9)$$

$$3CaO + 2B \rightarrow 3Ca + B_2O_3 \quad (10)$$

$$3MgO + 2B \rightarrow 3Mg + B_2O_3 \quad (11)$$

In addition to the above reactions, sulfur, oxygen and nitrogen in the molten steel bath are reacted by aluminum (Al), titanium (Ti), niobium (Nb), tantalum (Ta) and boron (B) to be added in the first place as follows.

$$\underline{2Al} + \underline{3O} \rightarrow 3Al_2O_3 \quad (12)$$

$$\underline{Al} + \underline{N} \rightarrow AlN \quad (13)$$

$$\underline{Ti} + \underline{O} \rightarrow TiO \quad (14)$$

$$\underline{Ti} + \underline{N} \rightarrow TiN \quad (15)$$

$$2Nb + 3O \rightarrow Nb_2O_3 \quad (16)$$

$$2Nb + 3S \rightarrow Nb_2S_3 \quad (17)$$

$$Nb + N \rightarrow NbN \quad (18)$$

$$2Ta + 3O \rightarrow Ta_2O_3 \quad (19)$$

$$2Ta + 3S \rightarrow Ta_2S_3 \quad (20)$$

$$Ta + N \rightarrow TaN \quad (21)$$

$$2B + 3O \rightarrow B_2O_3 \quad (22)$$

$$2B + 3S \rightarrow B_2S_3 \quad (23)$$

$$B + N \rightarrow BN \quad (24)$$

In addition, the sulfur, oxygen and nitrogen components remained in the molten bath are removed by magnesium (Mg) and calcium (Ca) reduced and separated in the molten alloy as described above and as shown in the following formulae (25) to (30), and an extremely clean molten steel bath is obtained.

More particularly, the molten steel bath is in vacuo or a non-oxidizing atmosphere and a proper amount of 7-90% of CaO and 90-7% of MgO are present in the crucible or the lining of container, so that the reaction of the equation (2) easily proceeds on the right side as shown in the formulae (1) and (2). This reaction is considered to be the following complex reaction.

$$Ca + \underline{S} \rightarrow CaS \quad (25)$$

$$Ca + \underline{O} \rightarrow CaO \quad (26)$$

$$3Ca + \underline{2N} \rightarrow Ca_3N_2 \quad (27)$$

$$Mg + \underline{S} \rightarrow MgS \quad (28)$$

$$Mg + \underline{O} \rightarrow MgO \quad (29)$$

$$3Mg + \underline{2N} \rightarrow Mg_3N_2 \quad (30)$$

Thus, the deoxidation is carried out by added aluminum (Al), while both the deoxidation and the desulfurization are carried out by the active magnesium (Mg), calcium (Ca) and calcium aluminate ($3CaO.Al_2O_3$) generated by the reducing action of aluminum (Al).

These reactions extremely quickly proceed, and so the desulfurization and deoxidation are almost completed in several minutes after adding aluminum (Al) to the molten steel bath.

Further, the nitrogen content in the molten steel bath is gradually reduced with the lapse of time. This is because nitrogen (N) is separated from the molten steel bath with the evaporation of calcium (Ca), magnesium (Mg) and the like. This denitrifying rate is considerably raised according to the progress of the deoxidation and desulfurization in a non-oxidizing gas or in vacuo atmosphere such as argon gas.

Next, the reason why the components and compositions of refractories are limited in the present invention will be explained as follows.

(a) In case that the total content of CaO-MgO is 70% to more than 99.9%:

From a refining effect of active Ca and Mg by reducing CaO-MgO of refractories and an effect of improving hydration resistance of tertiary oxide, the above composition range is determined by taking their harmonic points into consideration.

(b) In case that $Al_2O_3$, $Cr_2O_3$, $ZrO_2.SiO_2$, $ZrO_2$, $SiO_2$, ZrC and C are 30–0.1%:

The above composition range is determined by taking the harmonic points of an improved effect of hydration resistance of CaO-MgO and a refining effect of CaO-MgO of refractories by a reducing agent such as Al and the like.

(c) In case of less than 30 ppm of oxygen, less than 30 ppm of sulfur and less than 150 ppm of nitrogen:

As a result of actual operation, the upper limits are determined by aiming at the range for attaining high purity steel.

(d) In case of 5–0.1 ppm of Mg and 25–0.1 ppm of Ca:

From a result in actual operation, Ca immediately after adding 0.1% of aluminum (Al) becomes 5 to 6 ppm within a tundish, and the calcium (Ca) content of product becomes 2 to 3 ppm, and hence, the content of residual calcium (Ca) is determined to be less than 25 ppm to 0.1 ppm.

In the same manner, the content of magnesium (Mg) within a tundish is reduced by half in a product, and as a result, the content of residual magnesium (Mg) is determined to be less than 5 ppm to 0.1 ppm.

EXAMPLE 1

80% of a CaO-MgO clinker and 20% of a zircon oxide containing 95% of $ZrO_2$ were mixed and fired at 1,600° C. to manufacture a crucible of 80 mm in outer diameter and about 160 mm in height. A high frequency vacuum induction furnace of 10 kw and 50 KHz was used for melting, and a desired amount of additive metal was added to about 1 kg of an electrolytic iron molten bath, in which concentration of O and S was previously adjusted, at an argon atmosphere in pressure at 1,600° C.

The additive metal was 0.5% of Al, and at least one element not more than 0.5% and more than 0.001% of Ti, Zr, Ce and the like having purity of more than 99%, if necessary, is added together with less than 5% of a solvent.

As a result of adding 0.5% of Al, the residual amounts of O, S, N, Mg and Ca in the electrolytic iron molten bath after 10 minutes were O=12 ppm, S=2 ppm, N=27 ppm, Mg=4 ppm, and Ca=1 ppm.

The desulfurization result after an experiment with the use of Ti, Zr and Ce was against S=2 ppm after adding Al, and in case of adding Zr, S=17 ppm, in case of adding Ti, S=20 ppm, and after adding Ce, S=95 ppm, resulting in less desulfurization effect of rare earth metal.

EXAMPLE 2

A Ca-Si alloy was added to an RH vessel, and a Ca-Si clad wire was added to a ladle after completing treatment in RH-type vacuum degassing device respectively, and a residual amount of Ca and a morphological change of an inclusion were examined. Table 1 shows the composition of Ca-Si alloy and Ca-Si clad wire added.

TABLE 1

| Chemical compositions of Ca—Si alloy and Ca—Si wire | | | |
|---|---|---|---|
| Material | Fe | Ca | Si |
| Ca—Si alloy | — | 32 | 60 |
| Ca—Si wire | 55 | 14.4 | 27 |

100 tons of low carbon aluminum killed steel in ladle was treated in an RH-type vacuum degassing device and continuously cast in bloom of 250×370 mm. The ladle is lined in a furnace wall with refractory bricks consisting essentially of 56% of CaO, 25% of MgO and 18% of $Cr_2O_3$, and as a slag lining, MgO brick was used.

Figure 6:
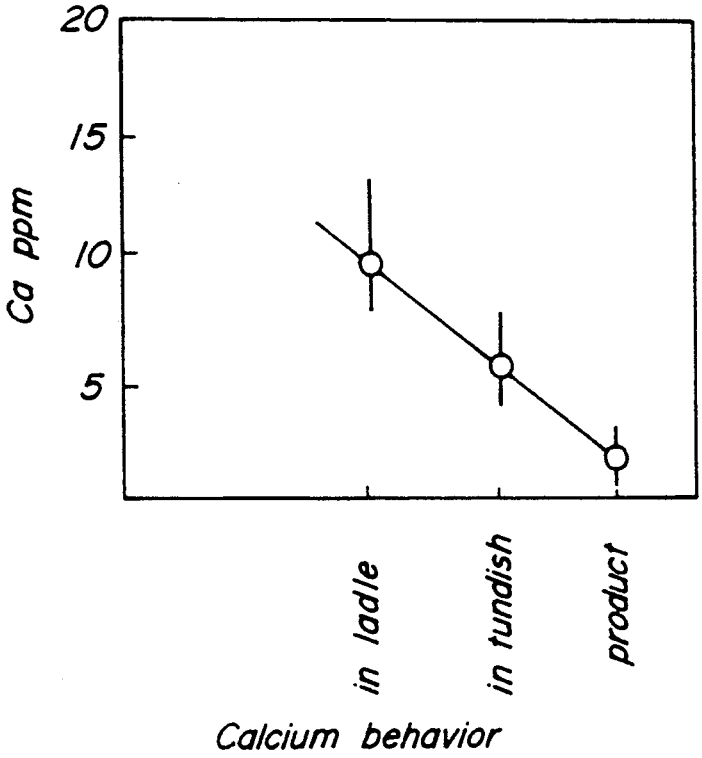
FIG. 6 is a graph showing a calcium behavior of the present product in tundish and ladle.

FIG. 6 shows an example of a behavior of Ca. The content of 10-odd ppm of Ca after addition into the ladle became 5–8 ppm in tundish. Residual Ca was 2–3 ppm and Mg was 3–4 ppm in product. In the product, $O_2$=12-9 ppm, S=8-12 ppm and $N_2$=28 ppm. There was no nozzle closure, nor morphological change of the inclusion.

EXAMPLE 3

With the use of a ladle of 80 tons having a furnace wall consisting essentially of tertiary refractories of 35% of CaO, 45% of MgO and 18% of $ZrO_2.SiO_2$, low chromium alloy steel was secondarily refined with basic slag in an RH-type vacuum degassing device.

Into the ladle, 0.1 of a Ca-Si clad wire (55% Fe, 14.4% Ca, 27% Si) was added into the ladle. The analytical result of typical 3 charge is as shown in Table 2.

TABLE 2

| Sample component | A | B | C |
|---|---|---|---|
| C % | 0.18 | 0.19 | 0.20 |
| Cr % | 1.15 | 1.27 | 1.10 |
| Ca ppm | 1.5 | 2.5 | 2.3 |
| Mg ppm | 1.1 | 1.6 | 1.4 |
| Sol Al % | 0.035 | 0.038 | 0.039 |
| $O_2$ % | 0.0010 | 0.0009 | 0.0011 |
| S % | 0.0018 | 0.0010 | 0.0015 |
| $N_2$ % | 0.0040 | 0.0035 | 0.0038 |

As described above, both the residual contents of Ca and Mg were less than 5 ppm, but deoxidation and desulfurization effects were as remarkably expected.

EXAMPLE 4

90% and 95% of a CaO-MgO clinker and 10% and 5% of a zirconium oxide containing 95% of $ZrO_2$ were mixed and fired at 1,600° C. to manufacture a crucible of 80 mm in outer diameter and about 160 mm in height.

A high frequency vacuum induction furnace of 10 kw and 50 KHz was used for melting, and a desired amount of additive metal was added to about 1 kg of an electrolytic iron molten bath, in which concentration of oxygen (O) and sulfur (S) was previously adjusted, at an argon atmosphere in pressure at 1,600° C.

The addition metal was 0.5% of aluminum, and 0.01% by weight of titanium having purity of more than 99%, if necessary, is added together with less than 5% of a solvent.

As a result of adding 0.5% of aluminum, the residual amounts of oxygen, sulfur, nitrogen, magnesium, titanium and zirconium in the electrolytic iron molten bath after 10 minutes, the result were as shown in Table 3.

TABLE 3

| | Chemical composition of basic refractories | | |
|---|---|---|---|
| | CaO % | MgO % | $ZrO_2$ % |
| First | 47.5 | 47.2 | 5.1 |
| Second | 44.5 | 44.2 | 9.8 |

TABLE 4

| | Chemical composition | | | | | | |
|---|---|---|---|---|---|---|---|
| | $O_2$ % | S % | N % | Ti % | Zr % | Ca % | Mg % |
| First | 0.0001 | 0.0001 | 0.0010 | 0.008 | 0.004 | 0.0002 | 0.0003 |
| Second | 0.0003 | 0.0001 | 0.0008 | 0.007 | 0.021 | 0.0003 | 0.0004 |

5% and 10% of $ZrO_2$ and a CaO-MgO clinker containing 50% CaO and 50% of MgO were mixed and fired at 1,600° C. to manufacture a crucible in the same manner as in Example 1. As a result, it was found that the refining effect is substantially the same even by changing $ZrO_2$ between 5 to 10%, and that there is no great difference. Therefore, it becomes clear that a refractory material consisting of a mixture of a CaO-MgO refractory material and $ZrO_2$ is effective in economy, resistance against hydration, and spalling.

What is claimed is:

1. A clean steel consisting essentially of by weight 0.0001%-0.5% of aluminum, 0.0001%-0.05% of silicon, 0.00001%-0.0005% of magnesium, 0.00001-0.0025% of calcium, 0.00001%-0.003% of oxygen, 0.0001%-0.003% of sulfur, and 0.0001%-0.015% of nitrogen, less than 2% of carbon, 0.0001%-0.5% of at least one element selected from the group consisting of titanium, niobium, tantalum, boron and the remainder iron.

2. A clean steel consisting essentially of by weight 0.0005%-0.5% of aluminum, 0.0001-0.05% of silicon, 0.00001%-0.0005% of magnesium, 0.00001%-0.0025% of calcium, 0.00001%-0.003% of oxygen, 0.00001%-0.003% of sulfur, and 0.0001%-0.015% of nitrogen, less than 2% of carbon, 0.0001%-0.5% of at least one element selected from the group consisting of titanium, niobium, tantalum, and boron, minor amount of phosphorous and manganese and alloy steel consisting of 0.001 ~ 50% of at least one element selected from the group consisting of nickel, chromium, tungsten, molybdenum, vanadium and the remainder iron.

3. A clean steel consisting essentially of by weight 0.0005%-0.5% of aluminum, 0.0001%-0.5% of silicon, 0.00001%-0.0005% of magnesium, 0.00001%-0.0025% of calcium, 0.00001%-0.003% of oxygen, 0.00001%-0.003% of sulfur and 0.0001%-0.015% of nitrogen, less than 2% carbon and the remainder iron, wherein the clean steel is further selected from the group consisting of carbon steel further consisting of 0.0001%-0.5% of at least one element selected from the group consisting of titanium, niobium, tantalum and boron; and alloy steel is further consisting of at least one element selected from the group consisting of nickel, chromium, cobalt, tungsten, vanadium and molybdenum as a special alloy steel element.

4. A clean steel as defined in claim 3, wherein the clean steel is further selected from the group consisting of carbon steel consisting of less than 2% of carbon, and common elements of silicon, manganese, phosphorus, sulfur; and alloy steel consisting of general elements and special elements selected from the group consisting of nickel, chromium, cobalt and tungsten.

5. A clean steel as defined in claim 3, wherein the clean steel is a medium alloy steel selected from chromium steel, nickel steel or a high alloy steel selected from a high chromium stainless steel, a high chromium nickel stainless steel.

6. A clean steel as defined in claim 3, wherein the clean steel consists essentially of by weight 0.0001%-0.5% of aluminum, 0.0001%-0.5% of silicon, 0.00001%-0.0005% of magnesium, 0.00001%-0.0025% of calcium, 0.00001%-0.003% of oxygen, 0.0001%-0.003% of sulfur, and 0.0001%-0.015% of nitrogen, less than 2% of carbon and 0.0001%-0.5% of at least one element selected from the group consisting of titanium, niobium, tantalum and boron and the remainder iron.

7. A clean steel as defined in claim 3, wherein the clean steel consists essentially of by weight 0.0005%-0.5% of aluminum, 0.0001%-0.5% of silicon, 0.00001%-0.0005% of magnesium, 0.00001%-0.0025% of calcium, 0.00001%-0.003% of oxygen, 0.00001%-0.003% of sulfur, and 0.0001%-0.15% of nitrogen, less than 2% of carbon, 0.0001%-0.5% of at least one element selected from the group consisting of titanium, niobium, tantalum, and boron, minor amount of phosphorus and manganese and 0.001%-50% of at least one element selected from the group consisting of nickel, chromium, tungsten, molybdenum and vanadium and the remainder iron.

* * * * *